United States Patent [19]

Gill et al.

[11] 4,074,820

[45] Feb. 21, 1978

[54] SHOVEL LINKAGE FOR A HYDRAULIC EXCAVATOR

[75] Inventors: Stephen H. Gill, Aurora; Harvey A. Knell, Joliet; Joseph M. Tucker, III, Aurora, all of Ill.

[73] Assignee: Caterpillar Tractor Co., Peoria, Ill.

[21] Appl. No.: 689,780

[22] Filed: May 25, 1976

Related U.S. Application Data

[63] Continuation of Ser. No. 522,204, Nov. 8, 1974, abandoned, which is a continuation-in-part of Ser. No. 283,621, Aug. 24, 1972, Pat. No. 3,862,697.

[51] Int. Cl.[2] ..... E02F 3/32

[52] U.S. Cl. ..... 214/138 R; 214/771

[58] Field of Search ..... 214/138 R, 763, 770, 214/771, 778, 140

[56] References Cited

U.S. PATENT DOCUMENTS

| | | | |
|---|---|---|---|
| 3,028,026 | 4/1962 | Palmberg | 214/778 |
| 3,239,083 | 3/1966 | Guinot | 214/138 R |
| 3,570,691 | 3/1971 | Guinot | 214/778 |

*Primary Examiner*—Trygve M. Blix
*Assistant Examiner*—Ross Weaver
*Attorney, Agent, or Firm*—Phillips, Moore, Weissenberger, Lempio & Majestic

[57] ABSTRACT

A hydraulic excavator having linkage providing for a front loading arrangement whereby the bucket opens away from the vehicle comprises power cylinders and linkage arranged to provide a balanced system providing maximum application of power and optimum use of power applied to the material-handling bucket. The power cylinders are connected to the linkage in a manner to utilize maximum leverage of the linkage when maximum power is needed.

8 Claims, 6 Drawing Figures

SHOVEL LINKAGE FOR A HYDRAULIC EXCAVATOR

CROSS-REFERENCE TO RELATED APPLICATION

This is a coninuation, of Ser. No. 522,204, filed Nov. 8, 1974, now abandoned, which is a continuation-in-part of our copending application Ser. No. 283,621 filed Aug. 24, 1972 now U.S. Pat. No. 3,862,697, entitled Front Loading Hydraulic Excavator.

BACKGROUND OF THE INVENTION

The present invention relates to hydraulic excavators and pertains particularly to a linkage arrangement obtaining optimum power from an excavator.

Hydraulic excavators have come into widespread use because of their versatility for application in the construction industry. In many of these applications, it is desirable to apply more power to the bucket than is available from linkage of the particular machine. The prior art machines have not been designed to utilize the linkage in a manner to apply the maximum power that it is capable of handling.

This is especially so when the excavator is being operated with a front opening or front loading bucket. Such prior art excavators have failed to utilize the most efficient arrangement of linkage and power cylinders.

The excavator applies power to the bucket for cutting and the like solely through the manipulation of linkages, with the vehicle normally kept or maintained in a stationary position. This is in contrast to the usual loader machine wherein force or power is applied to the bucket for loading purposes by translation of the vehicle itself along the ground. In other words, power is applied to the excavator bucket by means of hydraulically operated linkages, whereas power is applied to the loader type bucket by means of the driving wheels of the vehicle. Thus, the movement of the bucket in an excavator is controlled during its operation through the manipulation of the linkage system.

The application of power to the bucket by means of the linkage system requires careful and precise control of the linkage itself in order to achieve proper manipulation of the bucket. An excavator normally employs a scissors-like linkage arrangement having a boom pivoted at one end of the excavator vehicle, and a stick pivoted at one of its ends to the outer end of the boom, and a bucket pivoted to the outer end of the stick. Hydraulic rams or motors are operatively connected for operation of each of the boom, stick and bucket, and are each provided with a separate control valve manipulated by the operator to control the respective motor.

One major problem with the prior art linkages is that the geometry thereof does not lend itself to the maximum application of force or power through the linkage. In other words, the linkage is normally arranged to move the bucket in the desired path and to apply some minimum satisfactory amount of power to the bucket. The maximum power capabilities of such prior art linkages then become the maximum power of their weakest link.

Force diagrams on prior linkages indicate that while many of them have optimum location of one or more of the components of the linkage, they fail to provide an optimum linkage arrangement for all components. Thus, they fail to take advantage of the possibility of transmitting the maximum amount of power through the linkage to the bucket. A front loading bucket, for example, should be able to develop almost enough power upon forward movement of the bucket to skid the tracks of the vehicle along the ground. It should be able to develop this much power without excessive-size hydraulic jacks within the linkage or without bending or breaking the linkage. Similarly, the linkage should be able to lift or apply an upward lift to the linkage that is sufficient to tilt the vehicle on its tracks. In order to accomplish this, an optimum arrangement of the linkage is necessary with an optimum location of the power cylinders.

The prior art is exemplified by the following U.S. Pat. Nos. 3,578,188 issued May 11, 1971; 3,570,691 issued Mar. 16, 1971; 3,536,216 issued Oct. 27, 1970; 3,028,026 issued Nov. 20, 1959; 2,852,149 issued Sept. 16, 1958; and British specification No. 1,200,133, which was published July 29, 1970.

SUMMARY AND OBJECTS OF THE INVENTION

It is a primary object of the present invention to provide a hydraulic excavator linkage system having a geometric configuration that is operative to transmit the maximum amount of power therethrough to the bucket.

Another object of the present invention is to provide a simple linkage that will utilize all available machine weight in proportion to hydraulic control forces such that an optimum distribution of forces is achieved.

A further object of the present invention is to provide an excavator linkage arrangement and hydraulic power system operative to make optimum utilization of power available by transmitting the maximum amount of power through the linkage to the bucket.

In accordance with the present invention, there is provided hydraulic excavator linkage especially suitable for front loading buckets having linkage geometry which transmits the maximum available power through the linkage to the bucket by optimum utilization of leverage and moment arms at critical times in the work cycle.

BRIEF DESCRIPTION OF THE DRAWINGS

The above and other objects and advantages of the present invention will become apparent from the following specification when read with reference to the accompanying drawings, wherein.

DETAILED DESCRIPTION OF PREFERRED EMBODIMENTS

Figure 1:
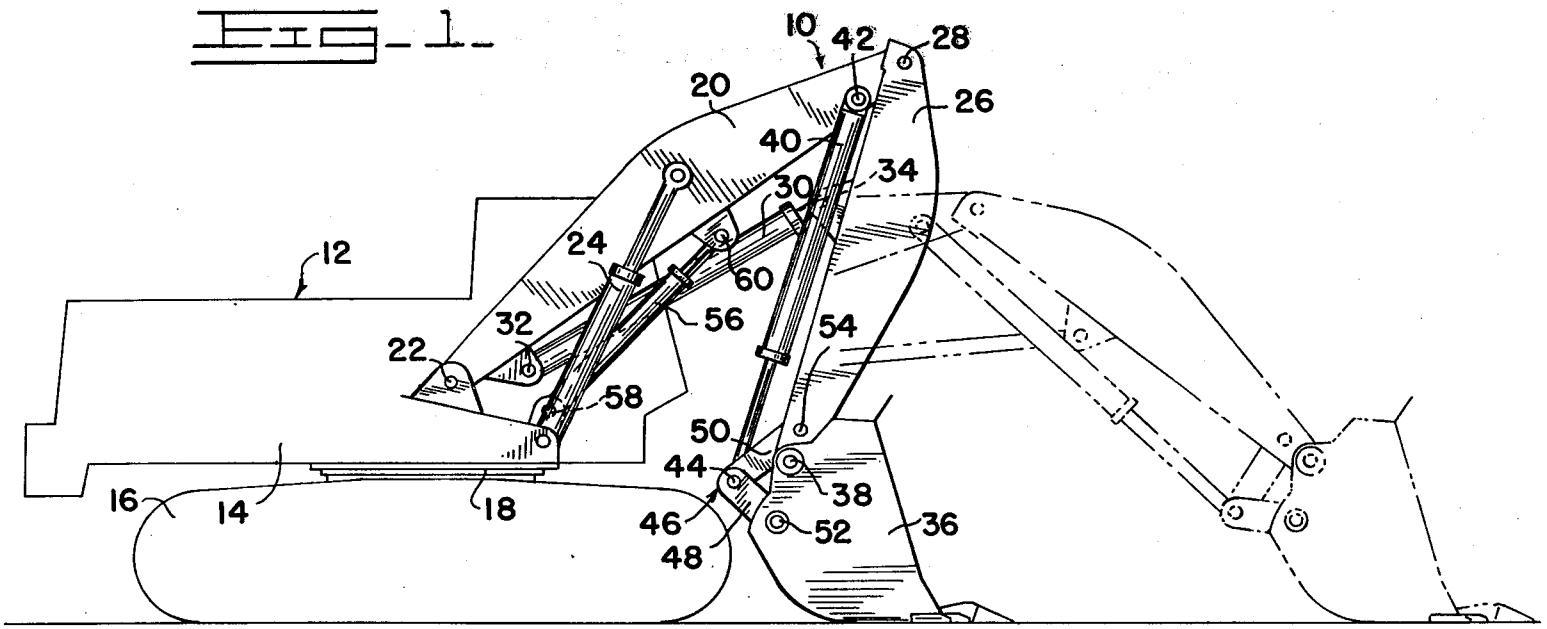
FIG. 1 is a side elevational view of an excavator embodying the linkage of the present invention with the linkage shown in the fully retracted position and shown in phantom in the fully extended position.
Figure 2:
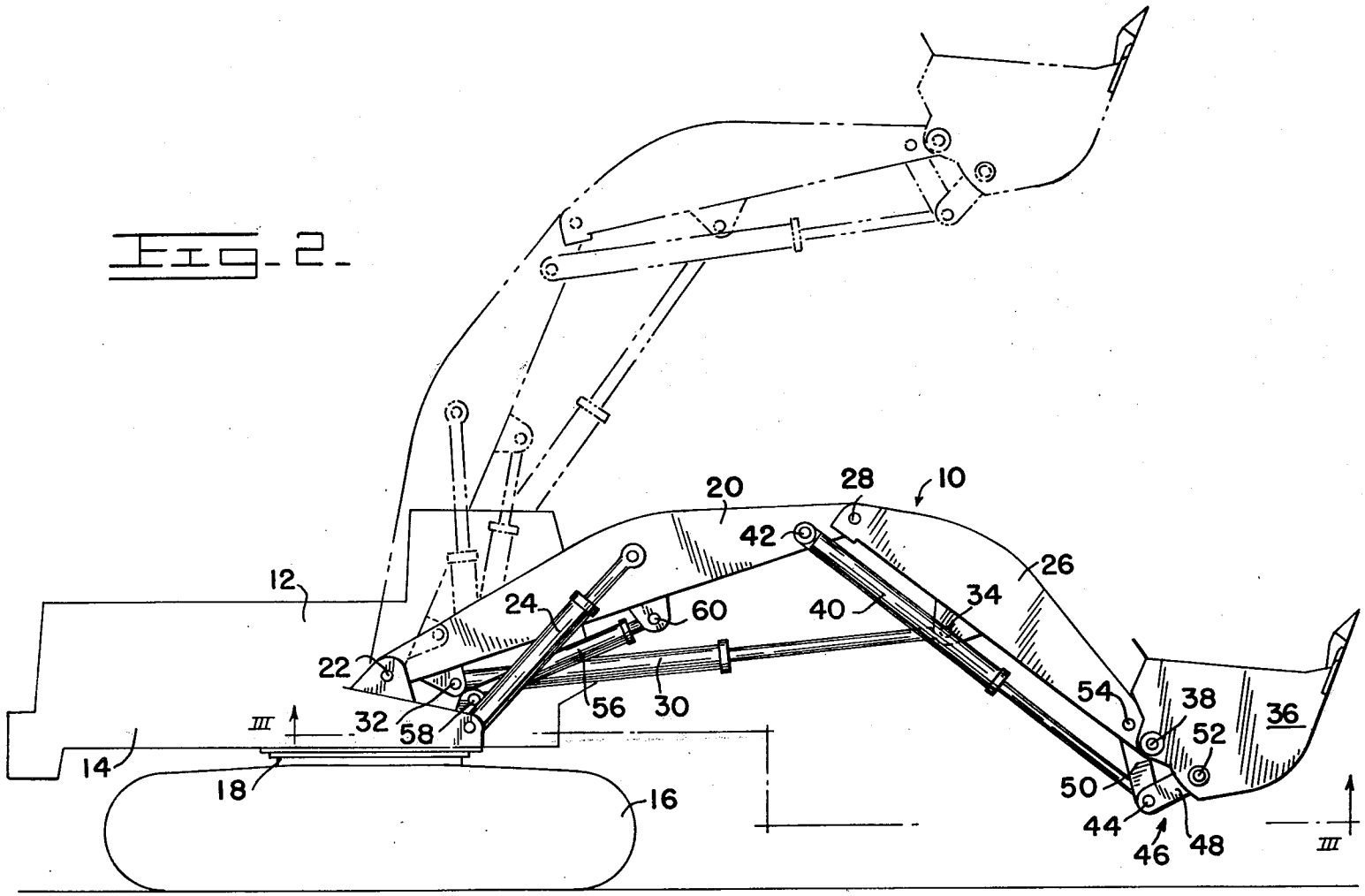
FIG. 2 is a view like FIG. 1 showing the linkage in the fully extended position.

Referring now to the drawings, and particularly to FIGS. 1 and 2, there is illustrated a bucket-actuating linkage generally designated by the numeral 10, operatively supported on a suitable vehicle 12 to form a hydraulic excavator which further comprises an upper frame or platform 24 rotatably mounted on a track undercarriage 16 by suitable bearing means 18.

Figure 3:
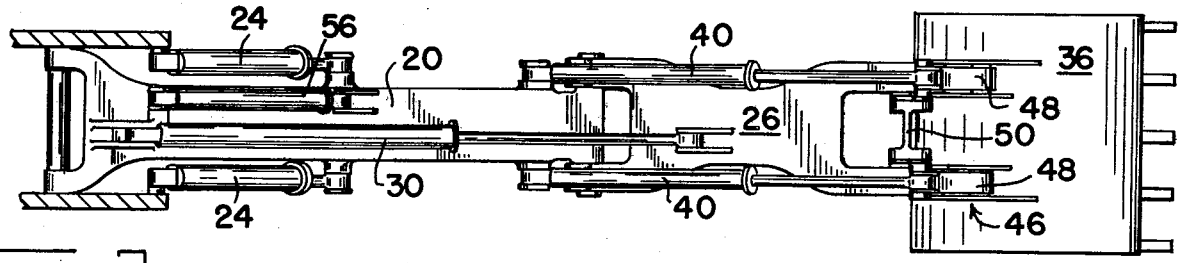
FIG. 3 is a view, taken generally along lines III—III of FIG. 2.

The bucket-actuating linkage comprises a boom 20 having one end pivotally connected to the frame at 22, with a pair of hydraulic hoist or lift jacks 24 operatively connected between the frame and the boom for controlling the pivotal movement of the boom 20 about pivot 22. The jacks are individually disposed on and connected to opposite sides of the boom (FIG. 3). The term "hydraulic jack" is used herein in the usual sense to refer generally to the well-known linear-acting hydraulic motor, also commonly known as a hydraulic cylinder.

It will be noted that the pivot point 22 is only slightly offset from the axis A of rotation of the upper structure 14. Thus, the force imposed at this point by the linkage is substantially at the center of the vehicle. It should also be noted that the jack 24 is pivotally connected at its lower end at a point spaced forward of and slightly below the pivot point 22, whereas the upper end thereof is pivotally connected substantially at the center of the boom 20. This arrangement provides maximum leverage on the boom 20 and at the same time permits maximum extension of the boom assembly as shown in phantom in FIG. 1.

The bucket linkage includes a stick 26 having one end pivotally connected at 28 to the outer end of the boom 20 and movable about pivot 28 by a hydraulic crowd jack 30, pivotally connected to the boom at 32 and to the stick at 34. The crowd jack 30 is disposed below the boom and offset to one side of the center line of the boom (FIG. 3) to provide room for a slave cylinder, as discussed later. The stick 26 is substantially the same length as the boom 20.

The pivotal connection of the crowd jack 30 to the boom 20 is at point 32 which is closely adjacent the lower or inner end thereof and pivot 22, with the outer end of the crowd jack 30 being connected at pivot 34 to the stick 36. The location of the lower pivot point 32 is such that enormous forces may be imposed thereon without imposing undesirable bending moments on the boom 20. The upper end 34 is pivotally connected at a position approximately one-third the distance between the upper pivot 28 and lower pivot 38 of the stick 26 to give an optimum lever arm on the stick as well as give optimum movement of the lower end thereof upon extension of the cylinder 30.

A bucket 36 is pivotally mounted at 38 to the lower end of the stick 26 and controlled in its pivotal movement about pivot mount 38 by a pair of spaced hydraulic bucket control jacks 40 pivotally connected to the boom at a pivot 42. The pivot 42 is spaced from the outer end of boom 20, and disposed intermediate pivots 22 and 28. The rods of the bucket control jacks 40 are operatively connected at 44 to a wrist linkage 46, which includes links 48 and 50 pivotally connected respectively to the bucket at 52 and stick at 54. The distance between pivots 28 and 42 are substantially the same as between pivots 38 and 44.

The bucket jacks and stick form opposite sides of a substantially parallelogram configuration. The wrist linkage 46 forms a third side of the parallelogram, and the portion of the boom between pivots 28 and 42 forms the fourth side. This linkage is not a true parallelogram at all times, since the link defined by jack 40 varies in length. The link 50 may also be longer than the distance between pivots 28 and 42, in order to maintain an adequate lever arm on the bucket.

Figure 5:
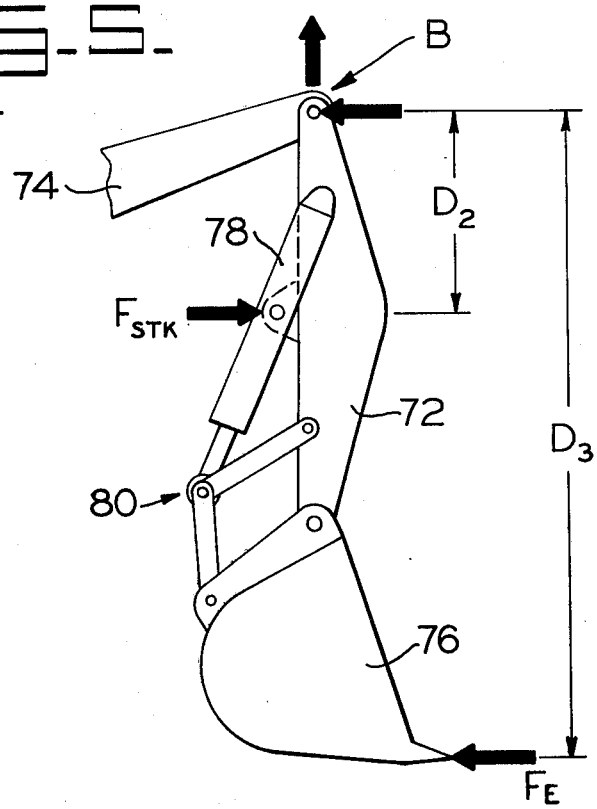
FIG. 5. PRIOR ART
FIG. 5 is a schematic layout of an example of the prior art with a force diagram applied thereto.
Figure 6:
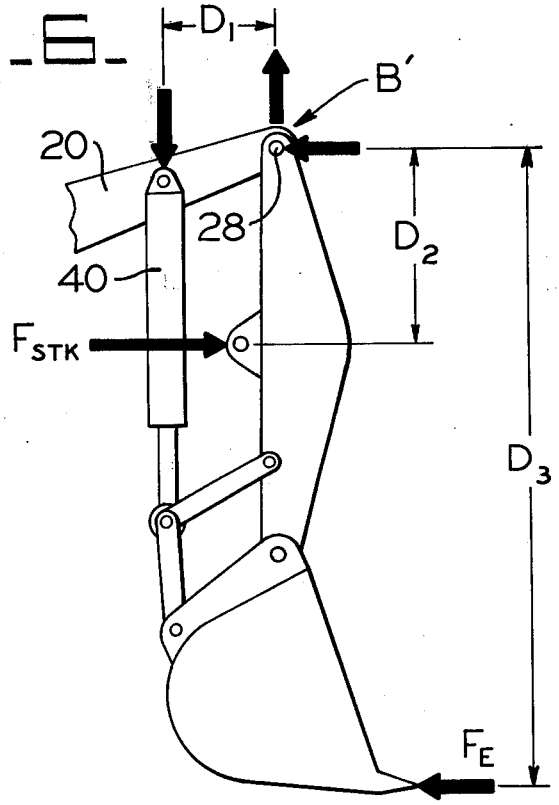
FIG. 6 is a schematic layout of a portion of the linkage of the present invention with a force diagram applied thereto.

This arrangement, with the bucket control jacks mounted to the boom, gives the bucket cylinder linkage approximately 30% more force capability than the usual stick-mounted cylinders. This will be apparent from a comparison of the force diagram for the two linkage arrangements (FIGS. 5 and 6).

It should be noted that the pivot connection 38 of bucket 36 to the stick 26 is forward of the pivot connection 52 of the bucket jack to the bucket. This in combination with the direction of the force applied by link 48 to the bucket permits an enormous amount of force to be applied to the bucket for breakout. This permits the bucket to be rocked back on its heel during breakout rather than simply lifted off the ground.

A hydraulic jack 56, hereinafter referred to as a slave cylinder, is connected between the frame and the boom at pivots 58 and 60, respectively. The slave cylinder is disposed below the boom and offset from the crowd jack 30 (see FIG. 3).

Figure 4:
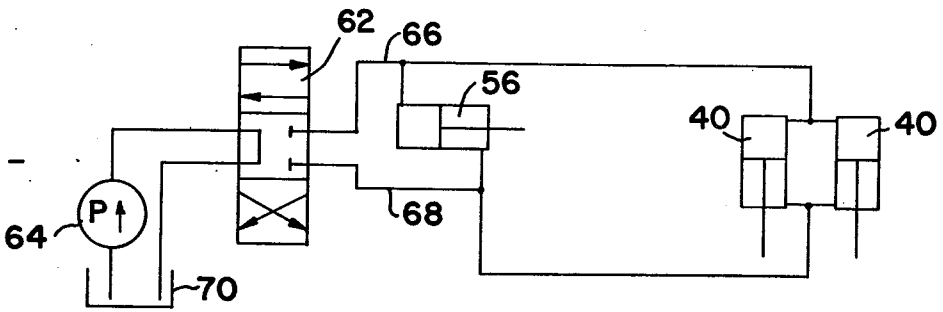
FIG. 4 is a schematic of a hydraulic control system of the present invention.

As shown in the schematic of FIG. 4, the rod end of slave cylinder 56 communicates with the rod ends of bucket control jacks 40, and the head end communicates with the head end of the jacks 40. Primary operation of the bucket jacks is controlled by a selector valve 62 which is selectively operable to direct pressurized fluid from a pump 64 to either side of jacks 40 via lines 66 and 68, and from either side thereof to sump 70. The slave cylinder 56 and the jacks 40 must be selected to have the appropriate volume for the desired relative movement.

Turning now to FIG. 5, there is illustrated an example of prior art linkages wherein a stick 72 is pivotally connected at its upper end to the outer end of a boom 74. A bucket 76 is mounted on the outer or lower end of the stick 72 and is actuated by a bucket cylinder 78 acting through wrist linkage 80. The bucket cylinder 78 is pivotally connected to the stick 72 and to the wrist linkage 80.

In contrast to the prior art just described, the bucket cylinders 40 of the present invention are connected to the boom instead of the stick in spaced relation to the connection of the stick to the boom. This arrangement gives additional force to the bucket edge, as will be illustrated below. Another significant feature of the present invention which is not normally considered by the prior art is that all cylinders are connected so that force is applied in the loading cycle by the head end of each of the jacks. This is significant in that the head end is much larger than the rod end and thus more power can be applied by the jack in that manner.

A force analysis of the linkages as illustrated in FIGS. 5 and 6 will illustrate the power advantage obtained by the present invention. Looking first to the prior art linkage as shown in FIG. 5, there is illustrated the forces acting on the linkage therein. In the force analysis the following terms will apply:

$M_e$ = the force applied to the cutting edge of the bucket;

$F_{bc}$ is the force applied by the bucket cylinder;

$F_{sc}$ is the force applied by the stick cylinder;

$d_1$ is the moment arm of the force of the bucket cylinder;

$d_2$ is the moment arm applied by the stick cylinder; and $d_3$ is the moment arm of the force acting on the bucket edge.

Looking first to the prior art configuration, a summation of the moments about point B, which is the pivot point of the stick 72, to the boom 74 gives the following:

$\Sigma M_B = F_{sc}(d_2) - F_e(d_3)$

Solving this equation for $F_e$ gives the following:

$$F_e = F_{sc}\left(\frac{d_2}{d_3}\right)$$

Turning now to the linkage of the present invention, $\Sigma M_{B'} = F_{dc}(d_1) + F_{sc}(d_z) - F_e(d_3)$.

Solving this equation for $F_e$ gives:

$$F_e = F_{bc}\left(\frac{d_1}{d_3}\right) + F_{sc}\left(\frac{d_2}{d_3}\right).$$

It is immediately apparent from the above equations that the equation for the force of the bucket edge for the present invention includes an additional factor which is the force of the bucket cylinder times the ratio of its moment arm to that of the bucket's moment arm. It is thus apparent that this arrangement gives an additional force or power to the cutting edge of the bucket.

Thus, from the above description, it is seen that we have provided a novel excavator linkage system that is operative to apply the maximum amount of power through the linkage system to the bucket. This linkage arrangement is arranged to take maximum advantage of the weight of the vehicle as well as to take maximum advantage of the maximum power that can be developed in hydraulic cylinders applied to the system and apply that maximum power to the cutting edge of the bucket.

While the present invention has been described and illustrated by means of the single embodiment, it is to be understood that numerous changes and modifications may be made therein without departing from the spirit and scope of the invention as defined in the appended claims.

What is claimed is:

1. A hydraulic excavator, comprising:

a vehicle having a mobile carriage and a rotary platform supported for rotation about a vertical axis on said carriage;

a boom having an inner and outer end, pivotally supported at said inner end of said rotary platform adjacent said vertical axis for movement about a horizontal axis;

a pair of boom lift cylinders pivotally mounted at one end to said rotary platform forward of and slightly below the connection of said boom thereto, and said cylinders being connected at the other end to said boom approximately midway between the ends thereof;

a stick having an inner end and an outer end and pivotally connected at the inner end to the outer end of said boom;

a stick cylinder pivotally connected at one end to said boom adjacent the inner end thereof and connected at the other end to said stick;

a bucket pivotally connected to the outer end of said stick and opening outwardly away from said vehicle; and bucket cylinder means pivotally connected at one end directly to said boom adjacent to the outer end thereof and connected at the other end to tilt linkage for tiling said bucket with respect to said stick, said tilt linkage being arranged for applying a forward force to said bucket, said bucket cylinder means together with said stick forming opposite sides of substantially a parallelogram and the force applied by the bucket cylinder means directly creating a moment about the connection of the stick to the boom, the connection of said bucket cylinder means to said boom being spaced inward from the connection of the stick to the end of the boom so that the moment about the pivotal connection of the stick to the boom when the bucket cylinder means are being extended tends to directly pivot the stick outward from the vehicle, the direct connection of said bucket cylinder means to said boom being spaced from the connection of said stick to said boom a distance substantially equal to the distance between the connection of said bucket to said stick and the connection of said bucket cylinder means to said bucket tilt linkage.

2. The excavator of claim 1 wherein said bucket opens away from said vehicle and said moment applied by said bucket cylinder means supplements the forces applied to the bucket by the stick and stick cylinder.

3. The excavator of claim 2 wherein the pivotal connection of said bucket to said stick is forward of the connection of said bucket cylinder means to said bucket.

4. The excavator of claim 3 wherein the connection of said stick cylinder to said stick is between one-third and one-half the distance from the connection of said stick to said boom and the outer end of said stick.

5. The excavator of claim 4 wherein said stick and said boom are substantially the same length.

6. The excavator of claim 3 wherein:

said pair of boom lift cylinders are spaced apart;

said bucket cylinder means comprises a pair of bucket cylinders that are spaced apart; and said stick cylinder extends between the cylinders in each of said pairs of cylinders.

7. The excavator of claim 6 wherein the cylinders in each of said pairs of cylinders are connected to opposite sides of said boom.

8. The excavator of claim 7 wherein extension of said pair of bucket cylinders leads to an upward moment being produced upon a leading edge of said bucket.

* * * * *